US011359315B2

(12) United States Patent
Heo

(10) Patent No.: US 11,359,315 B2
(45) Date of Patent: Jun. 14, 2022

(54) LOWER THREAD SUPPLY DEVICE OF SEWING MACHINE, AND SEWING METHOD

(71) Applicant: ONESTAR CO., LTD., Suwon-si (KR)

(72) Inventor: Pill Ho Heo, Seoul (KR)

(73) Assignee: ONESTAR CO., LTD., Suwon-si (KR)

( * ) Notice: Subject to any disclaimer, the term of this patent is extended or adjusted under 35 U.S.C. 154(b) by 144 days.

(21) Appl. No.: 16/622,986

(22) PCT Filed: Oct. 24, 2017

(86) PCT No.: PCT/KR2017/011789
§ 371 (c)(1),
(2) Date: Dec. 16, 2019

(87) PCT Pub. No.: WO2018/230777
PCT Pub. Date: Dec. 20, 2018

(65) Prior Publication Data

US 2020/0115834 A1 Apr. 16, 2020

(30) Foreign Application Priority Data

Jun. 14, 2017 (KR) ..... 10-2017-0075000

(51) Int. Cl.

| | |
|---|---|
| ***D05B 57/28*** | (2006.01) |
| ***D05B 57/08*** | (2006.01) |
| ***D05B 57/26*** | (2006.01) |
| ***D05B 1/12*** | (2006.01) |
| ***D05B 49/00*** | (2006.01) |

(52) U.S. Cl.
CPC ..... *D05B 57/28* (2013.01); *D05B 1/12* (2013.01); *D05B 49/00* (2013.01); *D05B 57/08* (2013.01); *D05B 57/26* (2013.01)

(58) Field of Classification Search
CPC ..... D05B 57/08; D05B 57/26; D05B 57/28; D05B 49/00; D05B 1/12
USPC ..... 112/231
See application file for complete search history.

(56) References Cited

U.S. PATENT DOCUMENTS 4,483,264 A * 11/1984 Ketterer ..... D05B 59/00 112/231
2007/0095263 A1* 5/2007 Sakuma ..... D05B 57/14 112/188

FOREIGN PATENT DOCUMENTS

| | | | |
|---|---|---|---|
| CN | 1117897 | C | 8/2003 |
| CN | 204509692 | U | 7/2015 |
| CN | 205529402 | U | 8/2016 |

(Continued)

*Primary Examiner* — Nathan E Durham
(74) *Attorney, Agent, or Firm* — KORUS Patent, LLC; Seong Il Jeong

(57) ABSTRACT

Disclosed herein are a lower-thread supply device of sewing machine and a sewing method. The device includes a bobbin case (300) having an outlet (330) from which lower thread is drawn out, and a needle through-hole (340) through which a needle (600) moving downwards with upper thread (a) being fitted passes, and a hook body (200) in which the bobbin case (300) is mounted, the hook body being installed to be rotatable by a power device of a sewing machine, guiding upper thread (a2) on a sewn fabric side to a front area of the bobbin case (300) while catching and dragging the upper thread (a) via a hook (210), and guiding upper thread (a1) on a spool side to a rear area of the bobbin case (300). The bobbin case (300) is installed not to be rotated when the hook body (200) rotates.

5 Claims, 13 Drawing Sheets

(56) References Cited

FOREIGN PATENT DOCUMENTS

| | | | |
|---|---|---|---|
| KR | 10-0819907 | B1 | 4/2008 |
| KR | 10-1492604 | B1 | 2/2015 |
| KR | 10-1626018 | B1 | 5/2016 |
| KR | 10-1657607 | B1 | 9/2016 |
| KR | 10-2017-0040595 | A | 4/2017 |

* cited by examiner

LOWER THREAD SUPPLY DEVICE OF SEWING MACHINE, AND SEWING METHOD

TECHNICAL FIELD

The present invention relates to a sewing machine. More particularly, the present invention relates to a device for supplying lower thread in a sewing machine and a sewing method using the device.

BACKGROUND ART

Generally, a rotary shuttle device is installed in a lower-thread supply device for supplying lower thread in a sewing machine. As shown in FIGS. 1 to 3, such a rotary shuttle device is mounted to a driving shaft that is rotatably provided in a power device of the sewing machine, and includes a hook body 20 referred to as an external hook, a bobbin case 30 accommodated in the hook body 20, and a means supplying lower thread, for example, a bobbin 40 around which the lower thread b is wound.

The hook body 20 is empty therein, has an entrance in a front thereof, and accommodates the bobbin case 30 therein, with the driving shaft being connected to a rear portion of the hook body. A hook 21 is formed on the hook body 20. Thus, if a needle 60 moves downwards with upper thread a being fitted into the hook, the hook 21 rotates while catching and dragging the upper thread. Further, an upper thread guide 22 is provided on an upper surface of the hook 21 and defines a predetermined gap to guide the upper thread a caught by the hook 21 to the front of the hook body 20.

The bobbin case 30 is rotatably accommodated in the hook body 20, an entrance is opened at a front of the case, and a rod-shaped stud 31 is set up on a bottom in the case. The bobbin 40 is rotatably fitted over the stud 31 or a passage through which the lower thread b passes is longitudinally formed, so that a passage along which the lower thread b is guided from an outside to an inside of the bobbin case 30 is formed. A separately provided cap 50 is coupled to the entrance of the bobbin case 30, thus closing the entrance.

A hook guide rail 37 is formed along an outer circumference of the bobbin case 30. The hook guide rail 37 corresponds to an end of the guide rail 36 protruding along the outer circumference of the bobbin case 30. When the hook 21 catches and drags the upper thread a while the needle 60 with the upper thread a descends and then ascends, the hook guide rail functions to guide upper thread a1 on a spool side through a gap between the hook body 20 and the bobbin case 30 to a rear of the bobbin case 30.

A groove 32 is formed in an edge of the entrance of the bobbin case 30. A protrusion 75 of a stopper 70 is separately provided on the groove 32 formed as such, and is secured to the sewing machine. Thus, the bobbin case 30 is fixed in position not to be rotated when the hook body 20 rotates. Further, a needle through-hole 34 is formed adjacent to a right side of the groove 32. The needle 60 moving downwards with the upper thread a being fitted therein passes through the needle through-hole 34.

The bobbin 40 that may be installed in the bobbin case 30 includes a take-up shaft 41 around which the lower thread b is wound, and flanges 42 which are formed on both ends of the take-up shaft 41. The lower thread b is wound around the bobbin 40. The lower thread b wound around the bobbin 40 is drawn out of the bobbin case 30 in a state where the bobbin 30 is accommodated in the bobbin case 30.

The bobbin 40 defines a passage through which the lower thread b passes in the stud 31, so that it may not be adopted when the lower thread b is fed from the outside to the inside of the bobbin case 30.

The bobbin case 30 is mounted not to rotate when the hook body 20 rotates. Such a configuration is achieved by the stopper 70. One end of the stopper 70 is fixed to the sewing machine, while a protrusion 72 is formed on the other end of the stopper. Thus, the protrusion 72 is fitted into the groove 32 formed in the bobbin case 30 to prevent the bobbin case 30 from rotating. In this configuration, the lower thread is pulled upwards through the groove 32 formed in the bobbin case 30, more precisely, a gap between the protrusion 72 of the stopper 70 in the groove 32 and a sidewall of the groove 32.

The groove 32 functions as a key way into which the protrusion 75 formed on the stopper 70 is inserted, and should be formed to a size to allow the lower thread b to be easily drawn out. Therefore, the groove is formed such that its width ensures a gap for the passage of the lower thread b in addition to the width of the protrusion 72.

As described above, when the hook body 20 rotates, the rotation of the bobbin case 30 is stopped by the stopper 70 so that the bobbin case is kept in a fixed position. In this state, the lower thread b drawn out from the bobbin case 30 is located in front of the needle through-hole 34 in a direction where the hook body 20 rotates.

Meanwhile, while the needle 60 descending with the upper thread a being fitted therein moves downwards to the lowermost point and then moves upwards, the upper thread a is caught by the hook 21. In this case, as shown in FIG. 2, the upper thread a is caught and dragged by the hook 21 from the back of the lower thread b that is drawn out from the bobbin case 30. This is the result of a relationship between a position where the lower thread b is drawn out and a position where the needle 60 with the upper thread a moves downwards to the needle through-hole 34.

If the hook body 20 continues to rotate in the state where the upper thread a is caught by the hook 21, the upper thread a is caught by the guide rail hook 37 formed on the bobbin case 30 to be pulled tautly. At the same time, as shown in FIG. 3, upper thread a2 on a sewn fabric is guided along the upper thread guide 22 to an area (hereinafter, referred to as a 'front area') around the entrance of the bobbin case 30 and rides over the front area of the bobbin case 30. The upper thread a1 on the spool side is guided to a gap between the hook body 20 and the bobbin case 30 and rides over an area (hereinafter, referred to as a 'rear area') around a rear side of the bobbin case 30. Consequently, the upper thread a passes down from the right of the lower thread b that is drawn out from the bobbin case 30 and then moves upwards to the left thereof, thus taking up the thread. Accordingly, the upper thread a forms a stitch together with the lower thread b.

Here, the stitch is made in a form in which the upper thread a winds spirally around the lower thread b once. Thus, the upper thread a and the lower thread b are not firmly interwoven with each other. If the lower thread b or the upper thread a is pulled by an external force in a state where a sewing operation has been completed, the lower thread or the upper thread is easily pulled, thus undesirably causing wrinkles on a sewn portion or causing seams to unravel.

DOCUMENTS OF RELATED ART

Patent Document (Patent Document 1) KR 10-0819907 (registered on Mar. 31, 2008) "Rotary shuttle device of sewing machine with lower-thread guard"

DISCLOSURE

Technical Problem

The present invention has been made to solve the above-mentioned problems and difficulties and relates to a lower-thread supply device, in which a stitch is formed in a variegated manner where upper thread ties lower thread, thus preventing the lower thread or the upper thread from being pulled in a sewn state, and a sewing method of performing a sewing operation in the variegated manner with the lower-thread supply device.

Technical Solution

In order to accomplish the above object, the present invention provides a lower-thread supply device including a bobbin case having an outlet from which lower thread is drawn out, and a needle through-hole through which a needle moving downwards with upper thread being fitted passes, and a hook body in which the bobbin case is mounted, the hook body being installed to be rotatable by a power device of a sewing machine, guiding upper thread on a sewn fabric side to a front area of the bobbin case while catching and dragging the upper thread via a hook, and guiding upper thread on a spool side to a rear area of the bobbin case, wherein the bobbin case is installed not to be rotated when the hook body rotates, and the outlet is formed in a position where the needle may move downwards to a left of the lower thread drawn out from the outlet, so that the upper thread is caught and dragged by the hook on the left of a front of the lower thread drawn out from the outlet.

Advantageous Effects

According to the present invention, upper thread winds lower thread to form a stitch in a variegated manner, so that the upper thread or the lower thread is not easily pulled in a sewn state, thus helping to maintain an original form of a sewn portion. Moreover, no matter where the sewn portion is cut, seams do not unravel. As the stitch is made in the form of a knot, it fills a needle hole created during the passage of a needle. Consequently, this prevents contents filled in fabric from escaping through the needle hole, and contributes to preventing water from penetrating into the needle hole.

MODE FOR INVENTION

Hereinafter, the present invention will be described in detail with reference to FIGS. 4 to 13 mainly with a configuration that is different from a conventional configuration.

Figure 1:
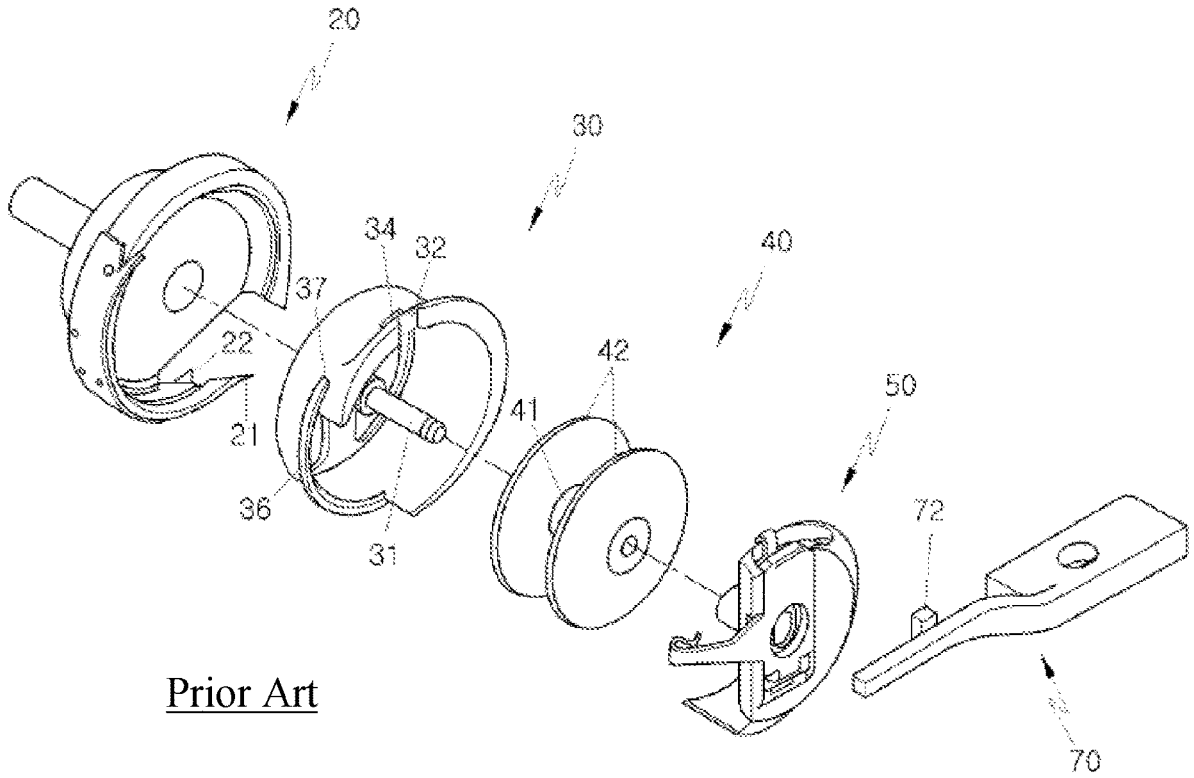
Prior Art FIG.1
FIG. 1 is an exploded view illustrating an example of a conventional lower-thread supply device.
Figure 2:
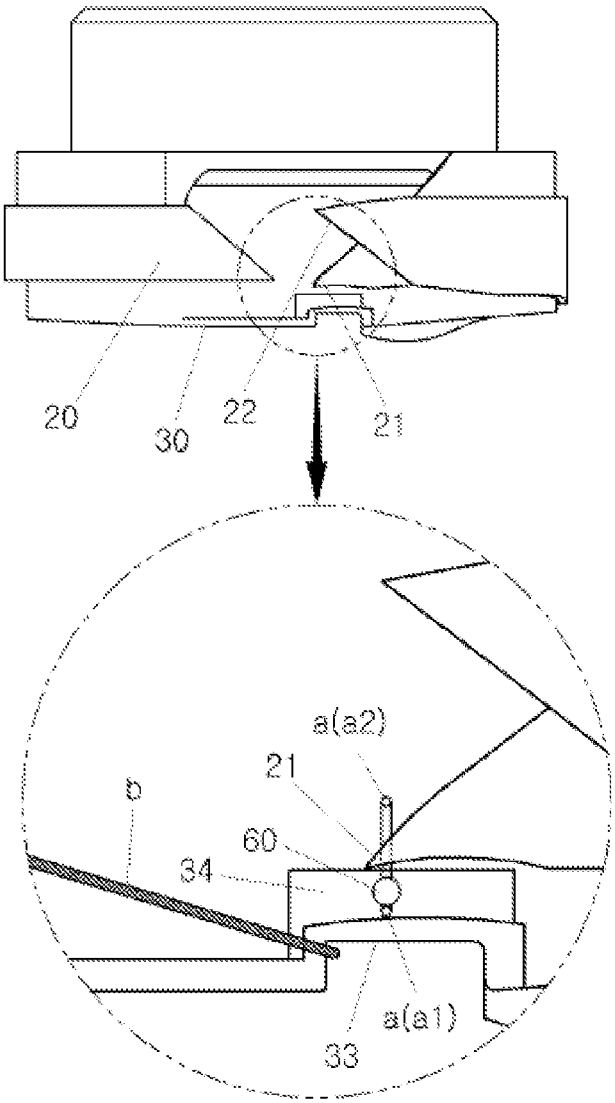
Prior Art FIG.2
FIG. 2 is a diagram illustrating a direction in which lower thread is drawn out, and a position in which upper thread is caught by a hook, in the conventional lower-thread supply device.
Figure 3:
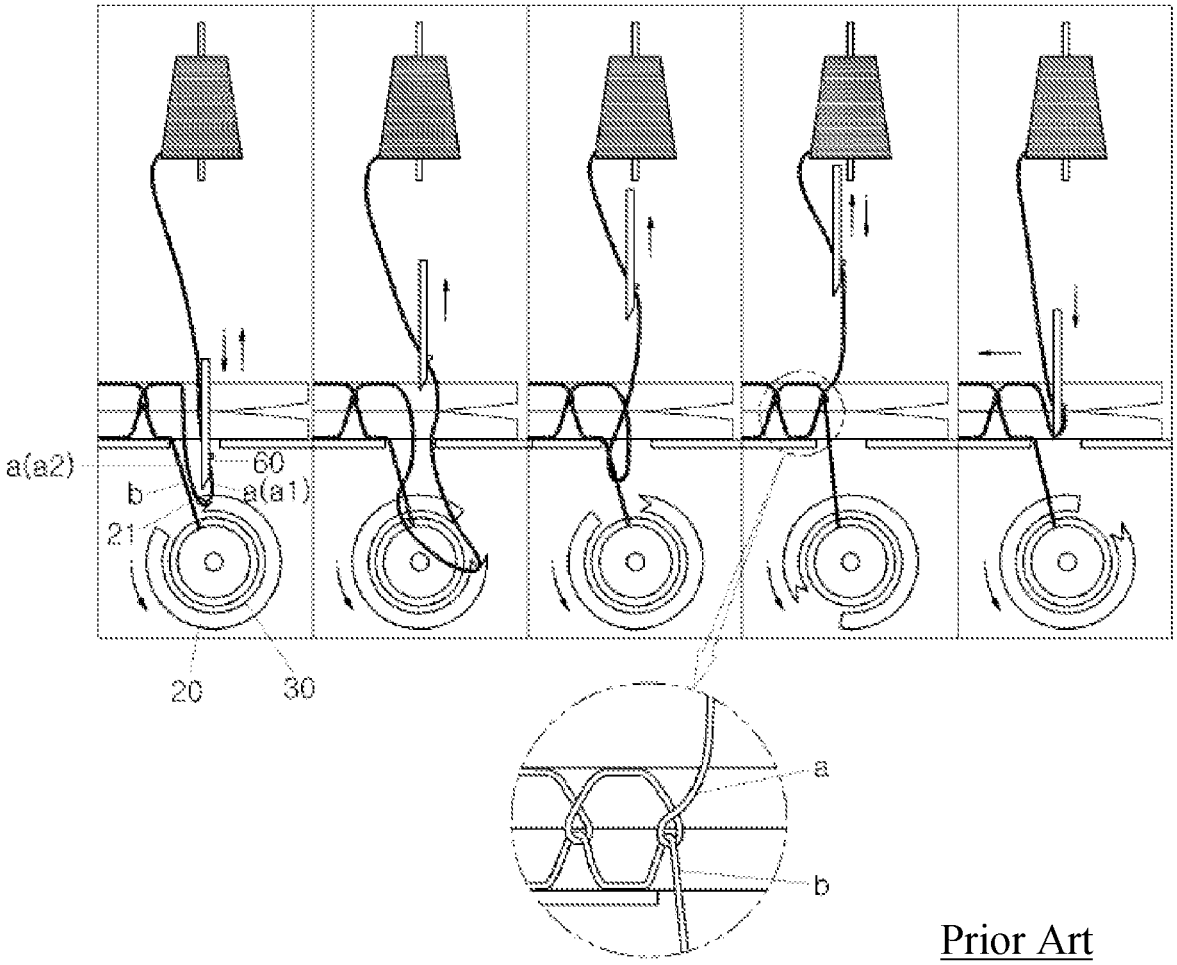
Prior Art FIG. 3
FIG. 3 is a diagram illustrating a stitch forming process by the conventional lower-thread supply device.
Figure 4:
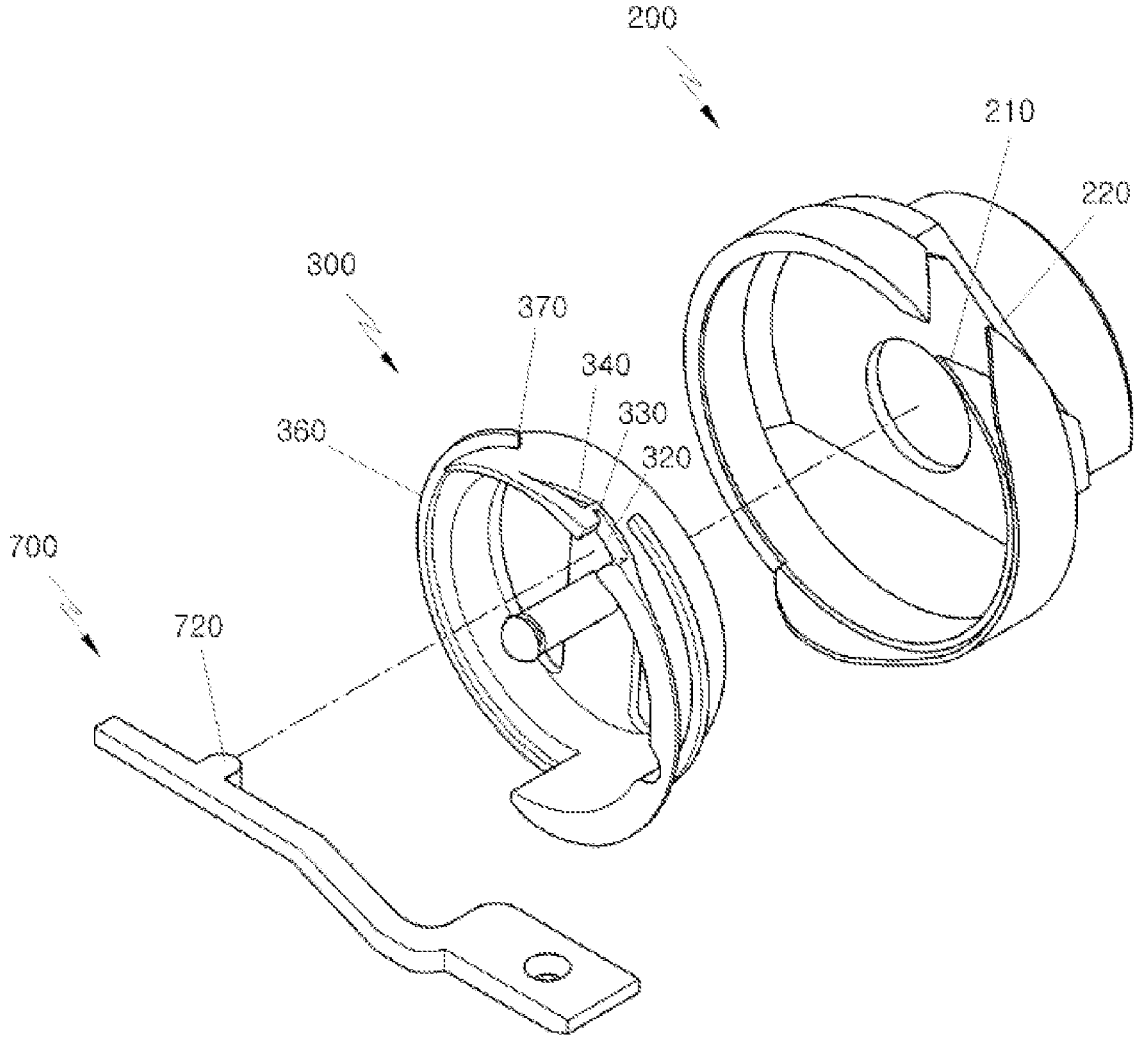
FIG. 4 is a diagram of a lower-thread supply device according to the present invention.
Figure 5:
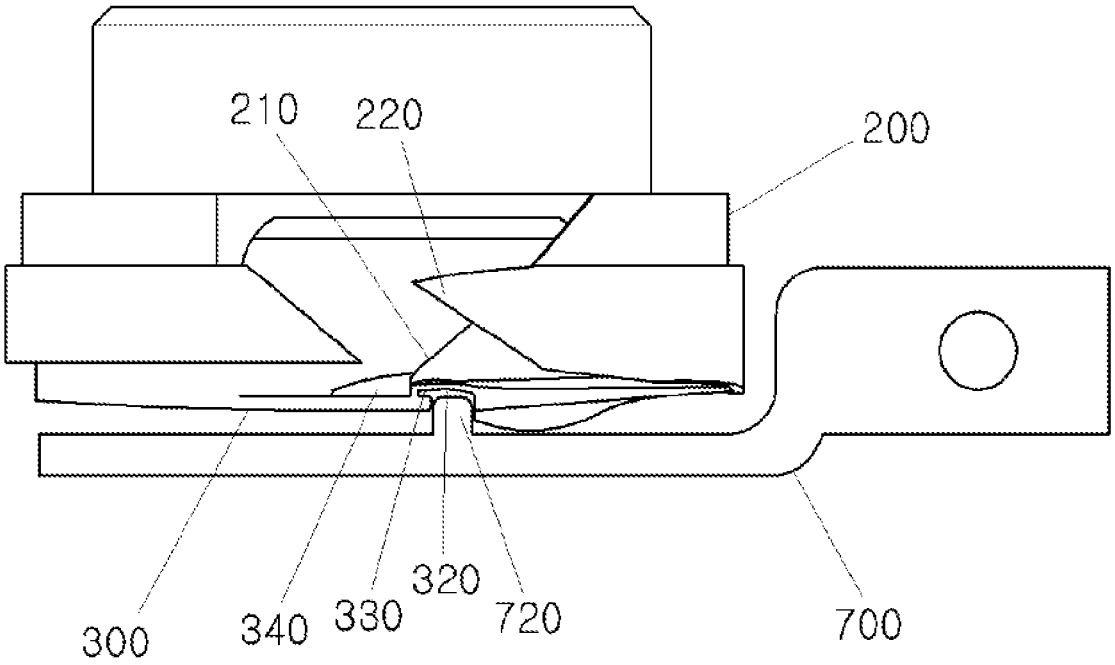
FIG. 5 is a plan view of the lower-thread supply device according to the present invention.
Figure 6:
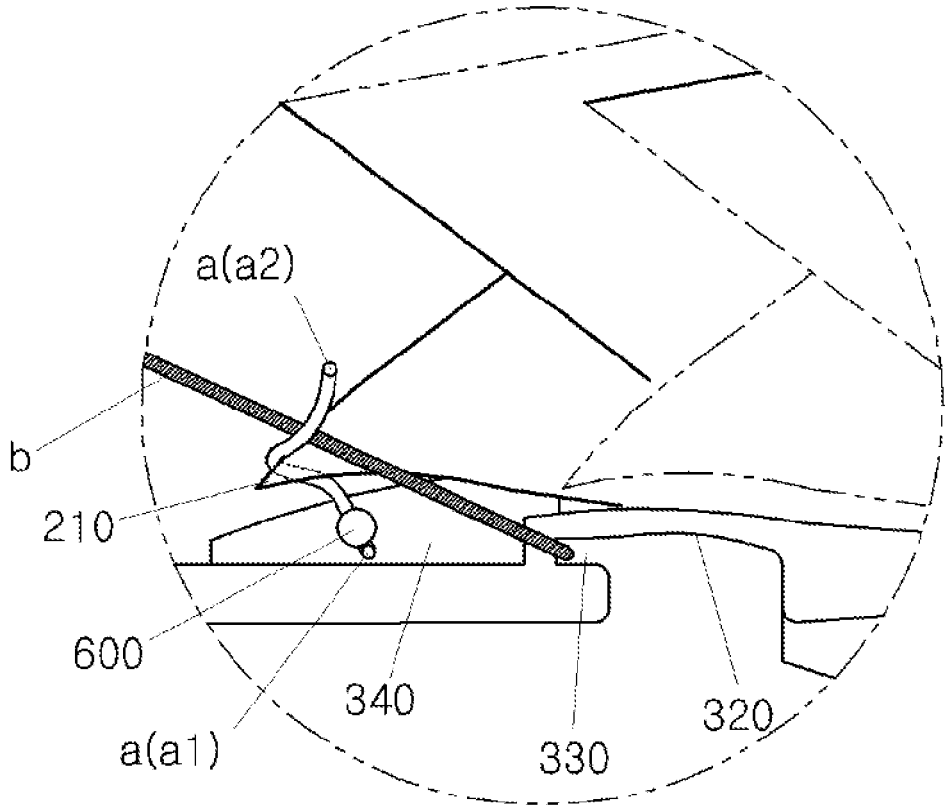
FIG. 6 is a diagram illustrating a direction in which lower thread is drawn out, and a position in which upper thread is caught by a hook, in the lower-thread supply device according to the present invention.
Figure 7:
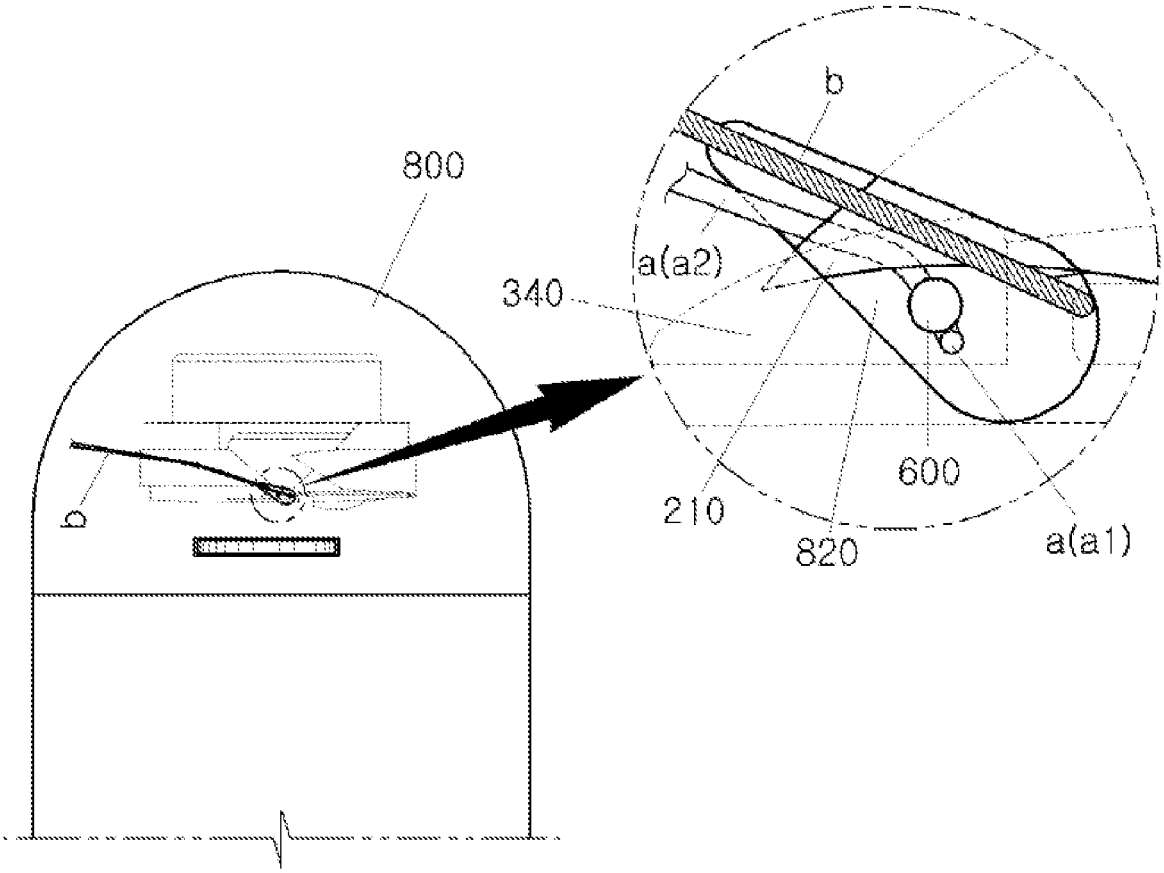
FIG. 7 is a diagram illustrating a structure of a needle plate that is applicable to the present invention.

FIG. 4 is a diagram illustrating a lower-thread supply device according to the present invention, FIG. 5 is a plan view of the lower-thread supply device according to the present invention, FIG. 6 is a diagram illustrating a direction in which lower thread is drawn out and a position in which upper thread is caught by a hook in the lower-thread supply device according to the present invention, and FIG. 7 is a diagram illustrating a structure of a needle plate that is applicable to the present invention.

As shown in the drawings, the lower-thread supply device according to the present invention includes a hook body 200 that is connected to a driving shaft of a sewing machine and rotates to drag upper thread a that moves downwards while being caught by a needle 600, and a bobbin case 300 that is accommodated in the hook body 200 to take lower thread b out from its interior.

The hook body 200 is empty therein and has an entrance in a front thereof. The driving shaft of the sewing machine is connected to a rear portion of the hook body. A hook 210 is formed on the hook body 200. Thus, while the needle 600 with the upper thread a moves downwards and then upwards, the hook 210 rotates while catching the upper thread a.

An upper thread guide 220 is formed on an upper surface of the hook 210. The upper thread guide 220 is inclined at an end thereof towards the front of the hook body 200, and is spaced apart from the hook 210 by a predetermined interval. The upper thread guide 220 guides upper thread a2 on a sewn fabric in the upper thread a caught by the hook 210 to a front area of the hook body 200.

The hook body 200 may adopt the conventional configuration and may also have the same function as the conventional function. Since its detailed configuration has been described in the section of 'Background Art', a duplicated description thereof will be omitted herein.

The bobbin case 300 is rotatably accommodated in the hook body 20, with an entrance being formed in a front of the bobbin case. The bobbin case is empty therein so that a means for supplying lower thread b is formed therein. Similarly to the related art, the means for supplying the lower thread b may be the bobbin around which the lower thread b is wound. If no bobbin is adopted, the lower thread b may be continuously fed from the outside to the inside of the bobbin case 300.

A hook guide rail 370 is formed along an outer circumference of the bobbin case 300. The hook guide rail 370 is provided on an end of a guide rail 360 that protrudes along an outer circumference of the bobbin case 300. When the upper thread a is caught and dragged by the hook 210, the hook guide rail serves to guide the upper thread a1 on the spool side through a gap between the hook body 200 and the bobbin case 300, thus allowing the upper thread to ride over the rear area of the bobbin case 300. Such a hook guide rail 370 adopts the known configuration.

An outlet 330 and a needle through-hole 340 are formed in an entrance edge of the bobbin case 300. The lower thread b is pulled out of the bobbin case 300 through the outlet 330, and the needle 600 descending with the upper thread a being fitted therein passes through the needle through-hole 340.

Here, the outlet 330 is formed in a position where the needle 600 may move downwards to the left of the lower thread b that is drawn out from the outlet 330. Thereby, the upper thread a is hooked and dragged by the hook 210 on the left of the front of the lower thread b that is drawn out of the outlet 330. This configuration can be achieved because the outlet 330 is formed in the rear of the needle through-hole 340 on the same line as the needle through-hole with respect to a direction in which the bobbin case 300 rotates.

As shown in FIG. 6, the lower thread b drawn out from the outlet 330 is pulled out towards the fabric while being inclined towards the rear area of the bobbin case 300, so that the lower thread forms a stitch together with the upper thread a on the fabric. Since the outlet 330 and the needle through-hole 340 are formed in the above-described arrangement relationship, the upper thread a is caught and dragged by the hook 210 from the left of the front of the lower thread b that is drawn out from the bobbin case 300.

Meanwhile, according to the present invention, as shown in FIG. 7, a needle hole 820 may be formed in a needle plate 800 to be inclined towards the rear area of the bobbin case 300 in a direction from a front end to a rear end. The needle hole 820 is formed above the needle through-hole 340 in a vertical direction to allow the needle 600 to pass therethrough. Thus, the needle hole 820 is inclined towards the rear area of the bobbin case 300 in the direction from the front end to the rear end.

Preferably, the needle hole 820 is made in the form of a water drop as its space becomes narrower from the front end to the rear end. The front end of the needle hole 820 secures a sufficient space as the needle 600 passes through the needle hole, while the rear end of the needle hole allows the lower thread b and the upper thread a to be stably guided.

According to the above description, the lower thread b is pulled out while being biased towards the rear end of the needle hole 820. Thus, the lower thread b is inclined towards the rear area of the bobbin case 300, and this helps to take the lower thread out towards the fabric. In addition, according to the above-described configuration of the needle hole 820, the upper thread a2 on the sewn fabric side which moves downwards with the upper thread being fitted into the needle 600 is inclined from the rear area to the front area of the bobbin case 300 similarly to the lower thread b. Consequently, while the upper thread a moves downwards and then upwards with it being fitted into the needle 600, a loop biased towards the rear area of the bobbin case 300 is formed. Therefore, the upper thread a can be stably caught by the hook 210.

The bobbin case 300 is installed not to be rotated when the hook body 200 rotates. This can be realized by the stopper 700. One end of the stopper 700 is fixed to the sewing machine, while the protrusion 720 is formed on the other end of the stopper. Thereby, the protrusion 720 is fitted into the groove 320 formed in the entrance edge of the bobbin case 300, thus holding the bobbin case 300. In such a configuration, the outlet 330 may be formed inside the groove 320.

A separately provided cap may be coupled to the entrance of the bobbin case 300, thus closing the entrance.

Hereinafter, a process of sewing fabric with the lower-thread supply device according to the present invention will be described. FIGS. 8 to 13 are diagrams illustrating a stitch forming process by the lower-thread supply device according to the present invention.

Figure 8:
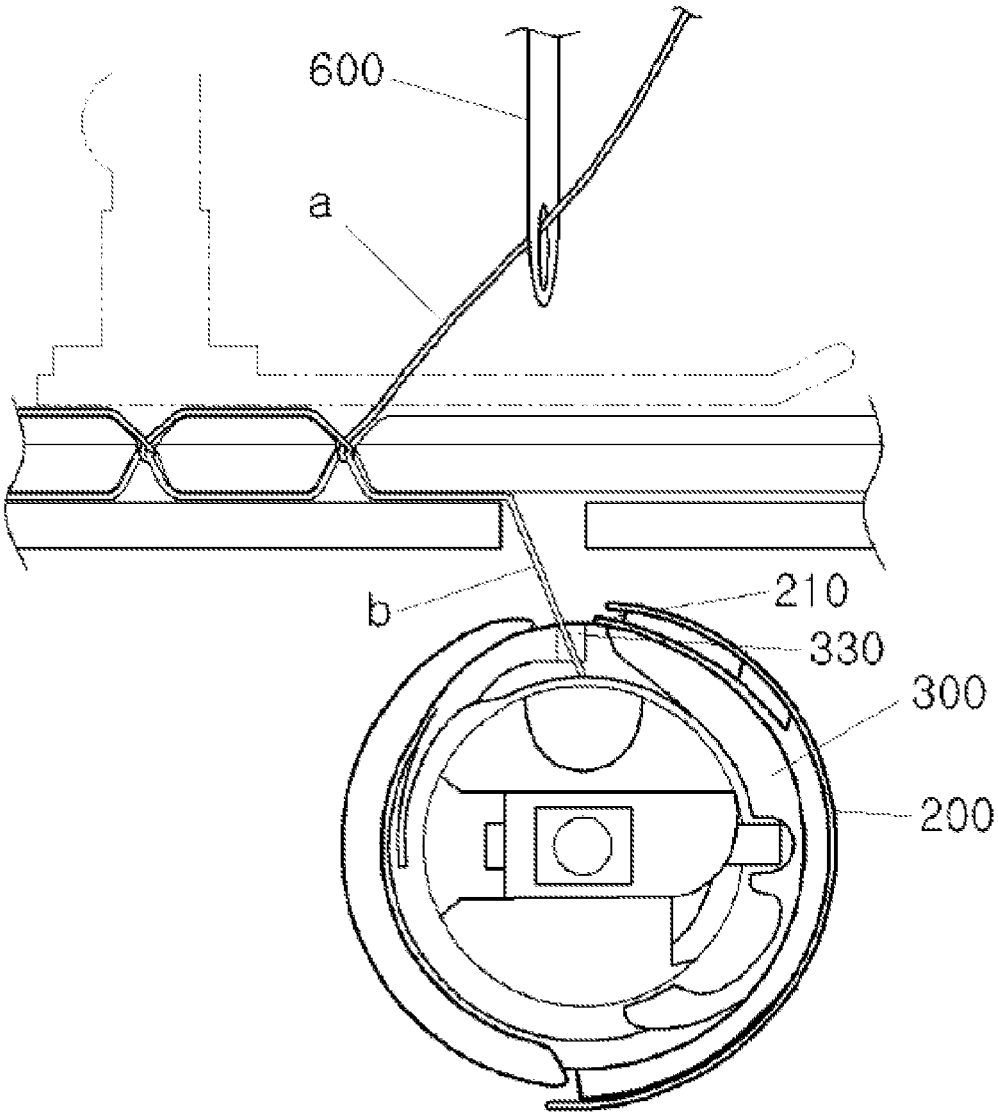
FIGS. 8 to 13 are diagrams illustrating a stitch forming process by the lower-thread supply device according to the present invention.

As shown in FIG. 8, when the hook body 200 rotates, the bobbin case 300 is prevented from being rotated and is locked in position. In this state, the outlet 330 is located behind a position where the needle 600 moves downwards, and the lower thread b is drawn out through the outlet 330 towards the sewn fabric.

Figure 9:
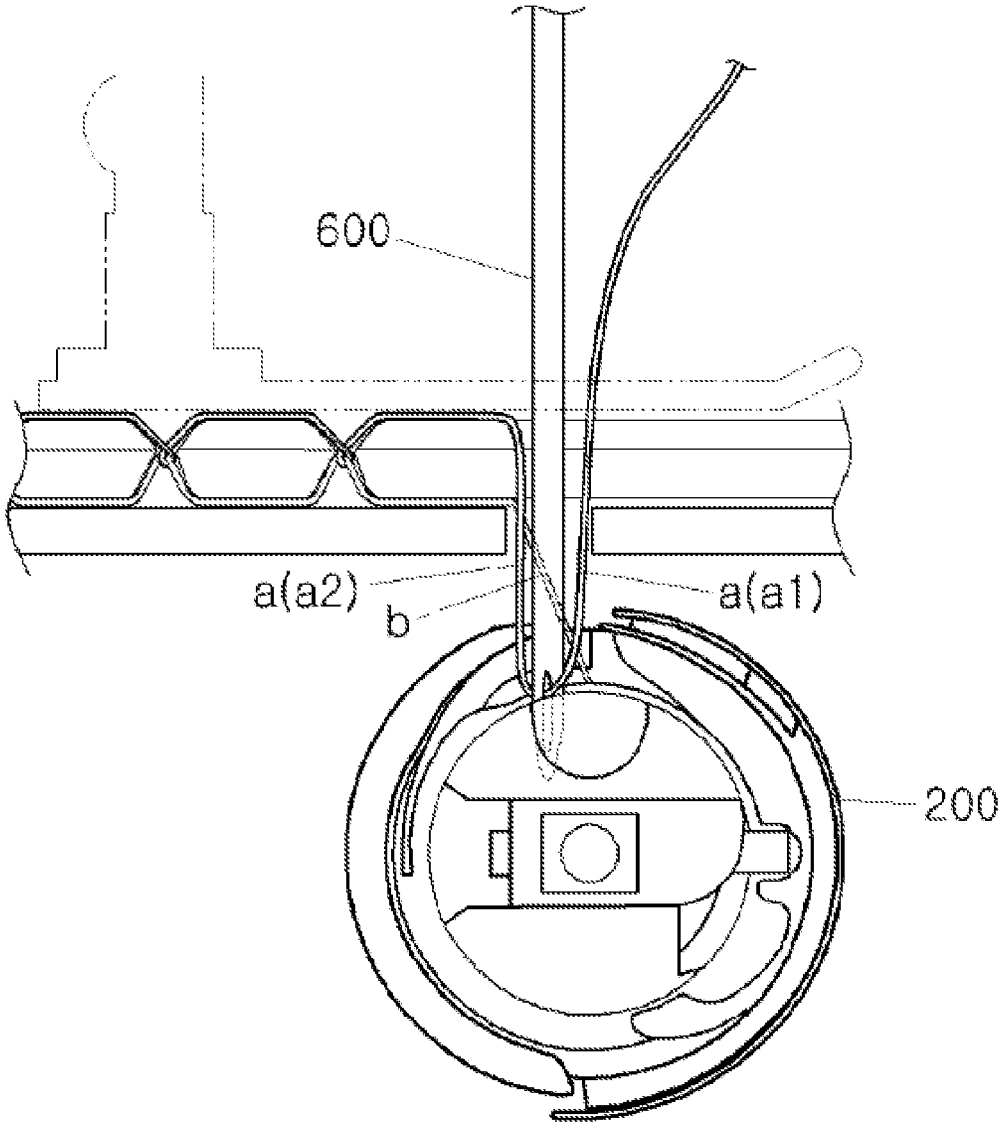

Thereafter, as shown in FIG. 9, if the needle 600 with the upper thread a moves downwards, the needle 600 moves downwards to the left of the lower thread b. Therefore, both the upper thread a2 on the sewn fabric side and the upper thread a1 on the spool side are located on the left of the lower thread b. Among the upper thread a, the upper thread a2 on the sewn fabric side is located in the rear area of the bobbin case 300 with respect to the needle 600, whereas the upper thread a1 on the spool side moves downwards while being disposed in the front area of the bobbin case 300.

Figure 10:
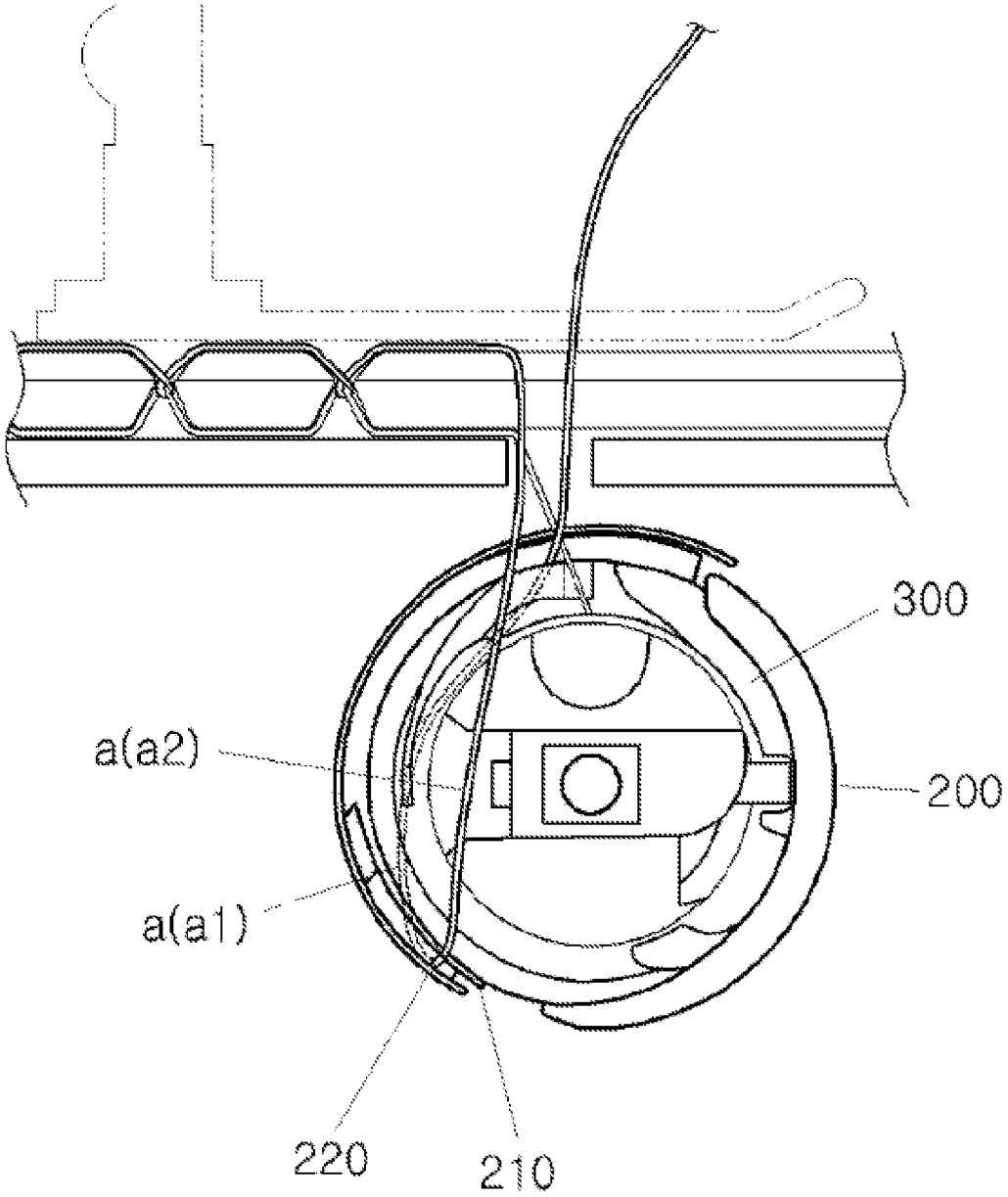
Figure 11:
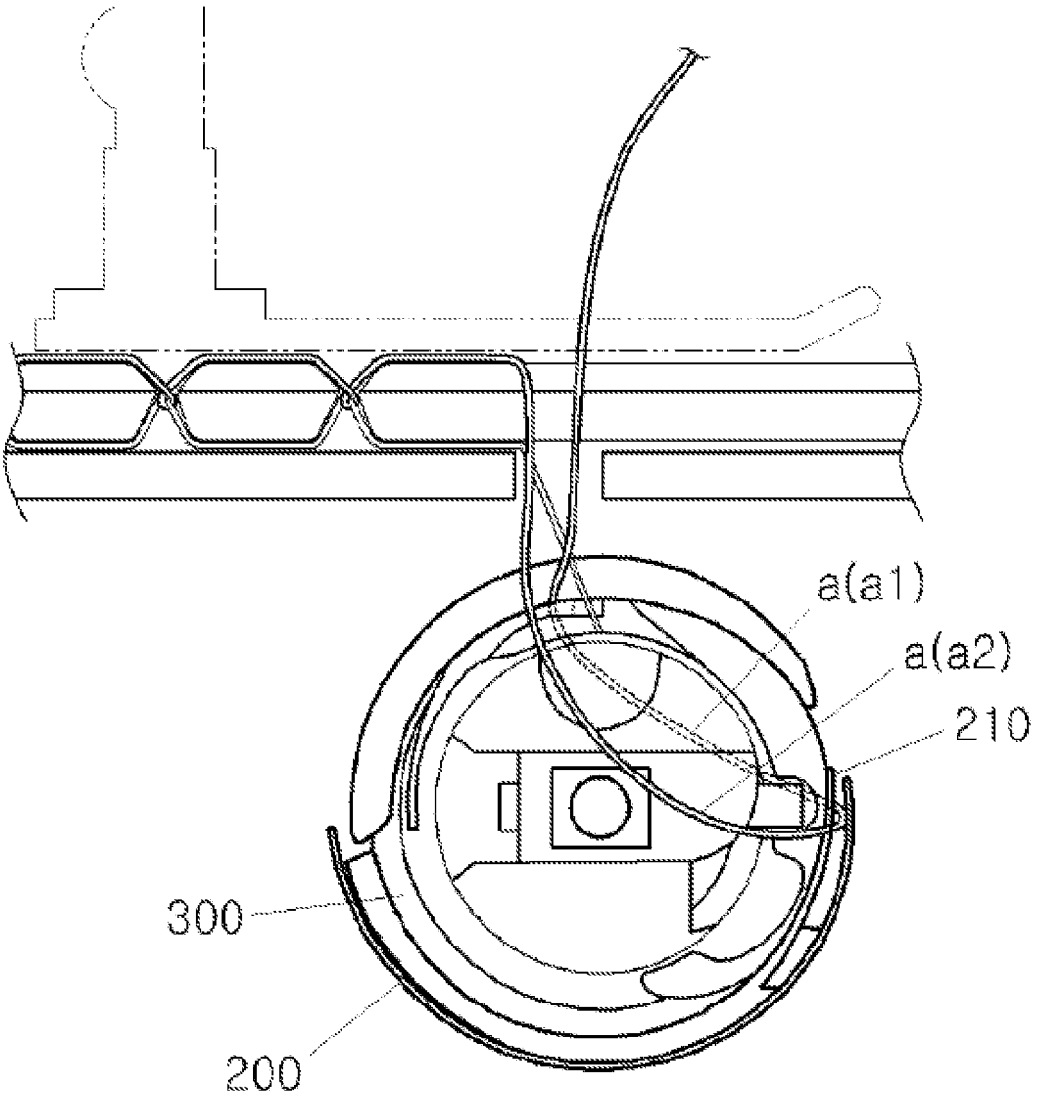
Figure 12:
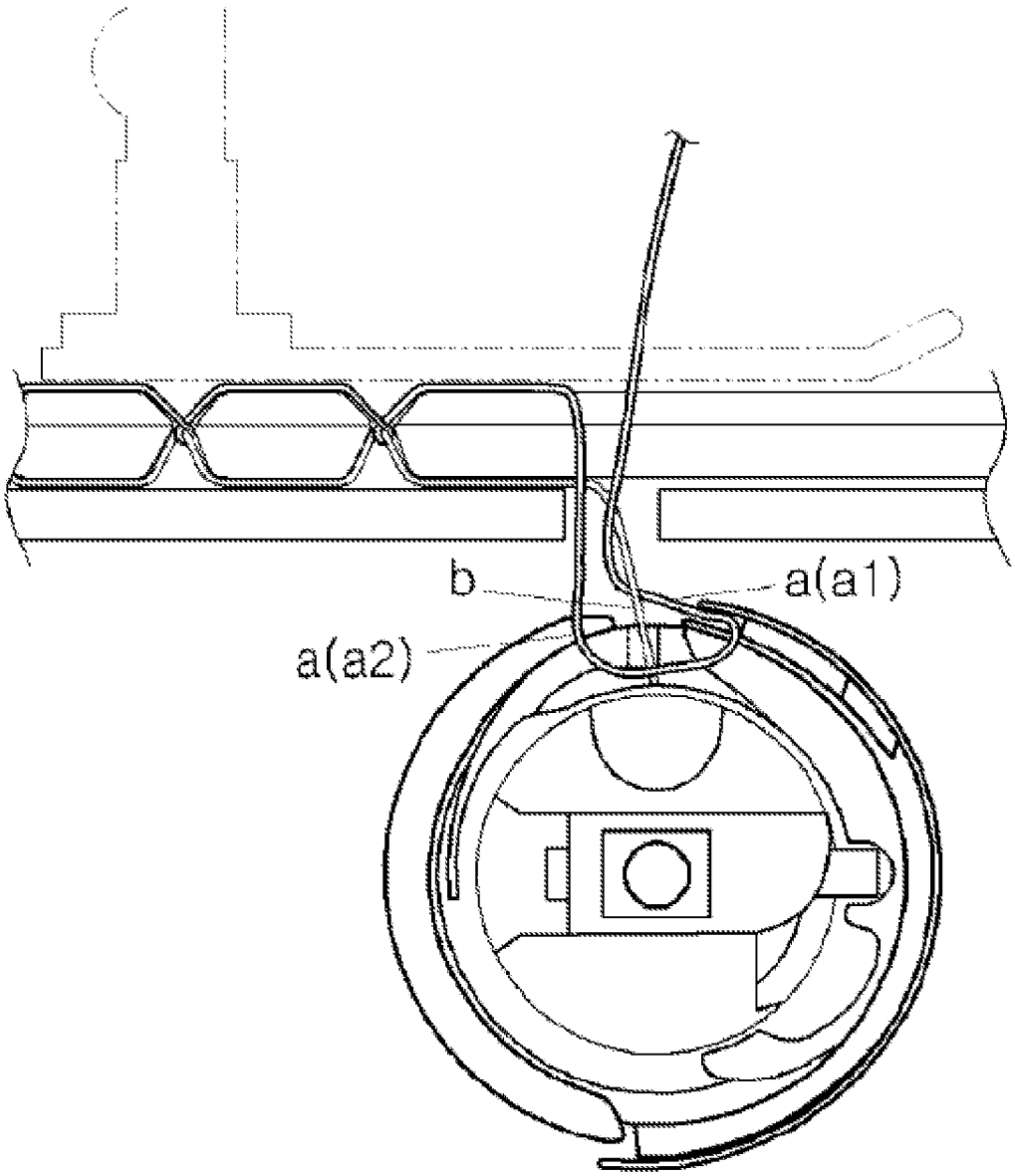
Figure 13:
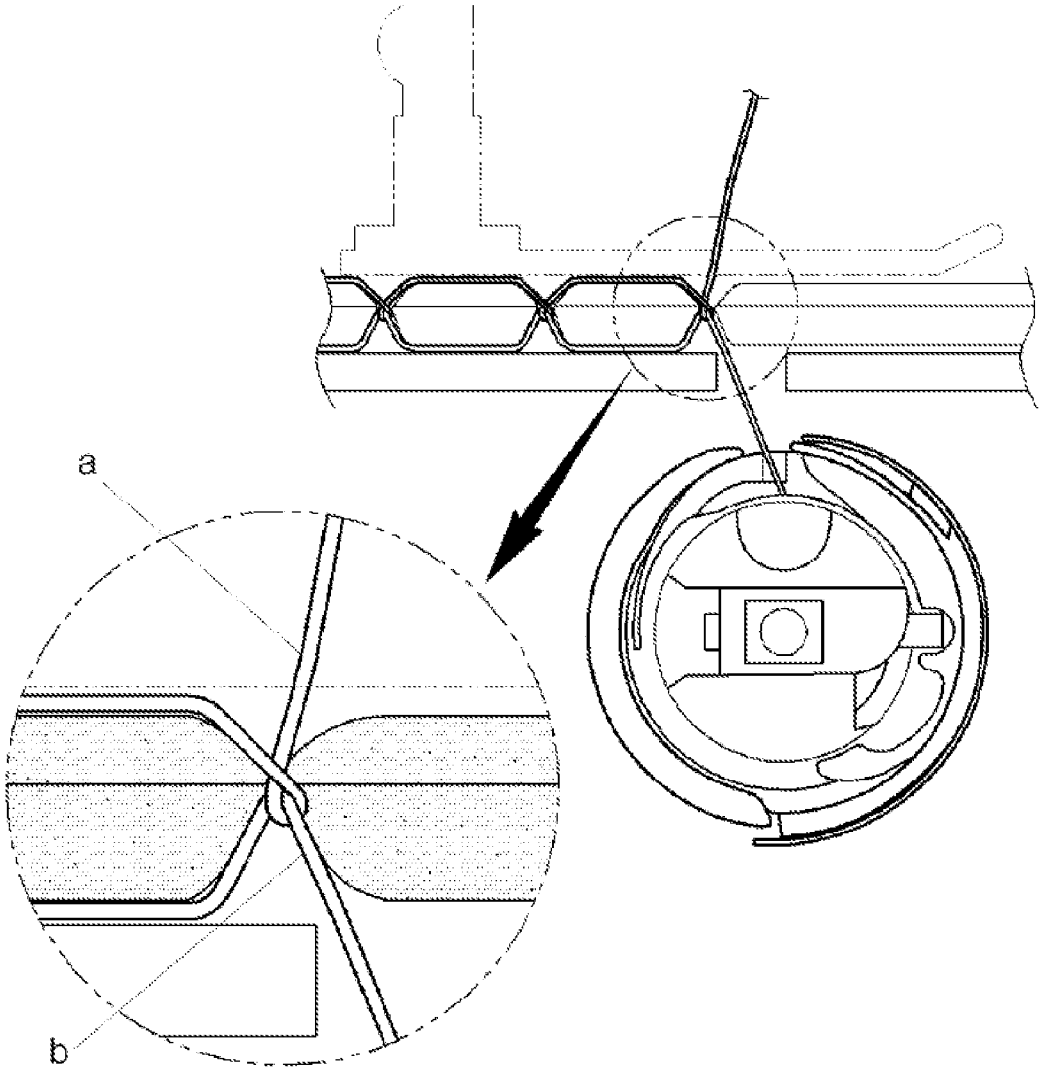

Subsequently, the hook body 200 catches and drags the upper thread a while continuously rotating. As shown in FIGS. 10 and 11, the upper thread a2 on the sewn fabric side is guided to the front area of the bobbin case 300 by the upper thread guide 220, and the upper thread a1 on the spool side is guided to the rear area of the bobbin case 300 while being guided to a gap between the hook body 200 and the bobbin case 300. Consequently, as shown in FIG. 12, the upper thread a1 on the spool side is wound around the lower thread b once while turning down from the right of the lower thread b and then moving upwards to the left thereof, and thereafter is pulled while passing between the upper thread a2 on the previously sewn fabric and the lower thread b. Therefore, as shown in FIG. 13, the upper thread a takes up the lower thread b in the variegated manner to form a stitch. The stitch creates the form of a knot, thus filling the needle hole formed while the needle passes through the fabric.

As described above, according to the present invention, a stitch formed when the fabric moves forwards on the needle plate 800 and a stitch formed when the fabric moves backwards are included, so that the knot form of stitches are formed in the same shape regardless of the moving direction of the fabric. Unlike the related art where the stitch formed when the fabric moves forwards is different in shape from the stitch formed when the fabric moves backwards, the invention can form the stitch of the same shape. Therefore, sewing operations can be easily performed in various directions, thus improving the convenience of work and productivity.

DESCRIPTION OF REFERENCE NUMERALS OF IMPORTANT PARTS

200: hook body,
210: hook,
220: upper thread guide,
300: bobbin case
320: groove,
330: outlet,
340: needle through-hole,
360: guide rail,
370: hook guide rail,
600: needle,
700: stopper,

720: protrusion,
800: needle plate,
820: needle hole.

The invention claimed is:

1. A lower-thread supply device comprising:

a bobbin case (300) including an outlet (330) from which lower thread is drawn out, and a needle through-hole (340) through which a needle (600) moving downwards with upper thread (a) being fitted passes;

a hook body (200) in which the bobbin case (300) is mounted, the hook body being installed to be rotatable by a power device of a sewing machine, guiding upper thread (a2) on a sewn fabric side to a front area of the bobbin case (300) while catching and dragging the upper thread (a) via a hook (210), and guiding upper thread (a1) on a spool side to a rear area of the bobbin case (300); and a needle plate (800) formed above the needle through-hole (340) to be spaced apart from the needle through-hole (340) by a predetermined interval, wherein a needle hole (820) is formed in the needle plate (800) to be inclined towards the rear area of the bobbin case (300) in a direction from a front end to a rear end of the needle hole, wherein the bobbin case (300) is installed not to be rotated when the hook body (200) rotates, and the outlet (330) is formed in a position where the needle (600) may move downwards to a left of the lower thread (b) drawn out from the outlet (330), so that the upper thread is caught and dragged by the hook (210) on the left of a front of the lower thread (b) drawn out from the outlet (330).

2. The lower-thread supply device of claim 1, wherein the outlet (330) is formed in a right side to the needle through-hole (340) on a same line as the needle through-hole (340).

3. The lower-thread supply device of claim 1, wherein the bobbin case (300) is installed not to be rotated by a stopper (700), and one end of the stopper (700) is fixed to the sewing machine, while a protrusion (720) is formed on an other end of the stopper, so that the protrusion (720) is fitted into a groove (320) formed in the bobbin case (300), thus preventing the bobbin case (300) from being rotated.

4. The lower-thread supply device of claim 3, wherein the outlet (330) is formed inside the groove (320).

5. A sewing method comprising:

taking lower thread (b) out from an interior of a bobbin case (300), catching and dragging upper thread (a), which moves downwards while being caught by a needle (600), by a hook (210) formed on a hook body (200), guiding upper thread (a2) on a sewn fabric side to a front area of the bobbin case (300), and guiding upper thread (a1) on a spool side to a rear area of the bobbin case (300), thus performing a sewing operation while taking up thread, wherein the lower thread (b) drawn out from the interior of the bobbin case (300) is pulled towards the fabric while being inclined towards the rear area of the bobbin case (300), and the upper thread is caught and dragged by the hook (210) from a left of a front of the lower thread (b) that is drawn out from the bobbin case (300) so that the upper thread (a1) on the spool side is wound around the lower thread (b) once while turning down from a right of the lower thread (b) and then moving upwards to a left thereof, and thereafter is pulled while passing between the upper thread (a2) on the previously sewn fabric side and the lower thread (b), and thus thread take-up is performed to form a stitch in a variegated manner.

* * * * *